US005425797A

United States Patent [19]

Dorofeev et al.

[11] Patent Number: 5,425,797

[45] Date of Patent: Jun. 20, 1995

[54] BLENDED CHARGE FOR STEEL PRODUCTION

[75] Inventors: Genrih A. Dorofeev, Tula; Serafim Z. Afonin; Yuri V. Utkin, both of Moscow; Aleksandr V. Makurov; Anatoly G. Sitnov, both of Tula, all of Russian Federation

[73] Assignee: UNI Superkom, Tula, Russian Federation

[21] Appl. No.: 200,714

[22] Filed: Feb. 23, 1994

[51] Int. Cl.[6] ..... C22B 9/10

[52] U.S. Cl. ..... 75/306; 75/318

[58] Field of Search ..... 75/306, 318

[56] References Cited

U.S. PATENT DOCUMENTS

| | | | |
|---|---|---|---|
| 121,245 | 11/1871 | Haserick | 75/318 |
| 1,381,771 | 6/1921 | Visintainer | 75/318 |
| 4,395,285 | 7/1983 | Merkert | 75/306 |

*Primary Examiner*—Peter D. Rosenberg

*Attorney, Agent, or Firm*—Webb, Ziesenheim and Bruening

[57] ABSTRACT

A blended charge for use as a decarburizing addition to a steelmaking batch comprises 50 to 95% by weight of an iron-carbon alloy and 5 to 50% by weight oxide material. The oxide material includes free metal oxides in excess of 0.25% by weight having an affinity for oxygen less than or equal to carbon in the molten steel.

12 Claims, No Drawings

BLENDED CHARGE FOR STEEL PRODUCTION

FIELD OF THE INVENTION

The invention is related to the production of iron and steel and particularly to the production of steel in electric furnaces.

BACKGROUND OF THE INVENTION

It is known that steel can be produced in an electric arc furnace which is initially charged material with scrap metal and a material in the form of iron-ore pellets cast with iron amounting to 0.5 to 5.0 ton per ton of scrap. The use of a charge containing pellets of a non-regulated content of an iron-carbon alloy (as pig iron) and iron oxide leads to a great range of carbon concentration upon melting (0.2 to 2.6%) which hinders metal refining. This increases the time of melting and sharply deteriorates the quality of steels and their chemical stability.

Also, the known charge, due to the variable chemical composition, has limited uses. Its utilization falls within the field of high-carbon steel production (i.e., 1.25% of carbon or more) by melting.

It is a technical advantage of this invention 1) to reduce the time of melting, 2) to improve the quality of steel and 3) to increase the range of metals obtained by electric furnace melting.

SUMMARY OF THE INVENTION

These advantages are achieved by utilization of a blended charge in steel production. The blended charge is composed of an iron-carbon alloy (50 to 95% by weight) and an oxide material (5 to 50% by weight). The oxide material contains free oxides of metals which have an affinity for oxygen that is equal to or less than the affinity of carbon for oxygen when the metal oxides are present in amounts in excess of 0.25% by weight. As a metallic component, iron-carbon alloys having 0.2 to 4.5% by weight of carbon are used, for instance, conversion pig iron. The oxide material may comprise oxidized flux-bearing and flux-free iron-ore materials, i.e., agglomerate or pellets of raw ores and their waste products, scale, oxidized metal scrap of a chip type, fragmented metal waste and solid oxidizers obtained by agglomeration of flue dust and sludge from metallurgical processes.

DESCRIPTION OF THE PREFERRED EMBODIMENTS

The oxide material is constituted, for example, by the oxides of iron and manganese in valence states II or III ($MnO$, $MnO_2$, $Mn_2O_3$ and $Mn_3O_4$) and also oxides of alloying elements chrome, nickel, molybdenum, tungsten and cobalt, provided that these elements are consistent with the steel grade under production. The affinity of these metals for oxygen in the condition of a steelmaking bath is lower than for carbon. This provides, in the process of melting, their reduction to metal by carbon existing in the metallic component of the steelmaking bath. The blended charge is formed with an iron-carbon alloy ranging from 50 to 95% by weight and 5 to 50% oxide material.

The utilization of a blended charge in which the iron-carbon alloy component amounts to more than 95% and the oxide material is less than 5% results in partial oxidation of silicon and other highly active elements during bath melting due to the lack of oxygen in the charge.

This does not allow the proper conduct of the oxidizing period during melting and hinders the removal of phosphorus and oxidation of carbon. The makeup of oxygen to oxidize the remaining content of silicon, phosphorus and carbon increases in time both the oxidizing period and the entire melting cycle thus producing the metal of a lower quality and thereby generally decreasing the effectiveness of electromelting. The amount of carbon in a metal tends to increase by the end of melting in a bath if the composition is as given above. This makes the oxidizing period longer and demands extra oxygen.

The use of a blended charge containing less than 50% of an iron-carbon alloy and, respectively, more than 50% of oxide materials results in a low carbon concentration in the bath during melting. This hinders further bath heating and obtaining the target temperature of metal at tapping. Besides, an excessive portion of oxide materials in the blended charge brings about a sharp cooling of the metallic bath and increases thereby the time of melting and power waste, thus producing metal of a lower grade with regard to the content of gas and inclusion components.

The required relationship between an iron-carbon alloy and oxide material components in the blended charge amounting to 50 to 95% and 5 to 50%, respectively, provides top technical and economic results in melting and obtention of steel of a high quality for various steel grades. It also allows to carry out complete oxidation of silicon and other highly active elements of a vanadium and titanium type (in case they compose metallic constituents of the blended charge) and thereby giving an opportunity for carbon and phosphorus oxidation at early stages. As the oxide material component of the blended charge grows and exceeds 5%, the amount of oxygen in the charge proves to be sufficient to oxidize a portion of the carbon. The emission of gaseous products in this reaction 1) enhances the transfer of heat and material in a bath, 2) accelerates the formation of a fluid slag stage, 3) intensifies slag-foaming and arc-shielding, 4) improves the conditions of metal heating, 5) accelerates carbon and phosphorus oxidation and 6) makes it easier to conduct slag flushing and phosphorus removal.

If the relationship between iron-carbon alloys and oxide material components falls within the weight ranges 70 to 80% and 20 to 30%, respectively, the amount of oxygen proves to be sufficient to carry out 1) complete oxidation of all alloy admixtures (including carbon, silicon, manganese) and 2) overall reduction of iron oxides to the metallic condition.

This relationship 1) provides for a maximum possible bath boiling, 2) eliminates the influence of the blend on the chemical composition of the metallic bath, 3) creates favorable conditions for metal refining and 4) decreases the time of melting. This composition of the blended charge is optimal. If the relationship between iron-carbon alloys and oxide material components is over 70:30, a part of the iron oxides that were not used in oxidation of alloy admixtures moves into the slag increasing its oxygen content and accelerating the dissolving of lime. This increases the refining and foaming characteristics of the slag, makes the removal of carbon, phosphorus, sulphur and gases deeper and also combines the periods of melting and oxidation. Thus, it results in the general decrease of the melting cycle. A gradual decrease of the iron-carbon alloy and respective increase of oxide materials in the blended charge is accompanied by a continuous decrease of iron supplied to the metallic bath from the blended charge. Beginning from the definite relationship between the charge constituents, the amount of iron that is reduced from iron oxides does not make up for the decrease of metal coming from the iron-carbon alloy. As a result, the output of hot metal decreases. Along with this decrease, the amount of slag and cooling of the bath increases. Thus, a higher amount of oxide materials in the blended charge (over 50%) leads to unjustified slag growth and excessive waste on heating, decomposition and melting of oxide materials and the feasible output generally decreases.

The charge composed of a higher amount of iron-carbon alloy and a lower portion of oxide materials can be used in the production of medium-carbon and high-carbon steels. The blended charge constituted by a lower iron-carbon alloy content and a higher content of oxide materials might be employed in a lower-carbon steel production, as well as, in the production of special low-carbon steel like stainless electrotechnical steel used in automobile sheet production, etc. Additionally, the blended charge having a high volume of oxide materials can be used as a coolant in an oxygen converter process, and also can be used in electric furnaces melting metallized pellets leaving a portion of the metal from the previous melt in the furnace ("swamp"). In the latter case, melting of the initial charge is accompanied by a local overheating of metal in the area coming under the arcs and also by the increase in hearth wear. This charge is characterized by the combination of a maximum cooling effect and purity. Under these conditions, the blended charge can be substituted for scrap as a coolant and also used in the production of steels with specific properties.

Free metal oxides that have a chemical affinity for oxygen (as much as and/or lower than carbon) in an amount of metal oxide of at least 0.25% by weight create conditions for complete reduction of iron oxides and other elements to metal and pure admixture-free metal arriving in the bath. Dilution of the metal bath with a pure molten metal decreases the concentration of unwanted elements which negatively influences the properties of steel and also increases the output of hot metal.

On the other hand, the oxygen in the oxide materials oxidizes the alloys of pig iron such as silicon, vanadium, titanium and other highly reactive elements first, and then the carbon. Mixing of the bath by the generated gaseous products of carbon oxidation intensifies heat and mass exchanges in the bath. The mixing effect starts from the melting of the first charged portion and continues through the entire melting period. This allows the formation of an active, fluid, highly foaming slag at the end of the melting period making it possible to terminate the arcs and to provide normal flushing which improves the conditions of dephosphorization and desulphurization of metal and bath degassing. The consequences of this are expressed in partial coincidence of the oxidation and melting periods, in the reduction of the melting cycle and in improvement of the quality of metal.

The occurrence of silicon in major iron-carbon alloys, particularly in pig irons, leads to its oxidation and formation of a silicon oxide that provides an acid slag with low basicity and yield during melting. Such slag weakly comes off the bath, has low foaming properties, hinders dephosphorization of the molten metal, has a negative impact on the furnace lining and delays carbon oxidation. The choice of free metal oxide content in excess of 0.25% by weight is required by 1) the conditions of an active fluid slag formation at the end of melting and 2) production of a given carbon content on deoxidation having regard for the iron-carbon alloy makeup and its relative portion in the blended charge.

The large amount of hot fluid slag produced by the end of the melting stage accelerates dephosphorization and desulphurization producing the metal with low concentration of phosphorus, sulfur and chrome. Due to this, the oxidation period is partially combined with melting which makes further conduct of this stage easier and reduces it to the adjustment of the carbon content by the addition of small solid oxidizers (i.e., agglomerate) and heating of the metal to a required temperature. Accelerated formation of a hot slag and metal allows steady arc combustion and sharply reduces the noise load to 10 to 12 minutes from the beginning of melting.

If the content of carbon and other admixtures is minimal both in iron-carbon alloy (0.2%) and in the blended charge, the free metal oxide content amounting to 0.25% or more is sufficient to conduct complete oxidation of a small amount of silicon, manganese and other admixtures.

A lower oxide content is unsuitable due to the lack of oxygen required in the oxidation of alloy admixtures. A higher oxide content is inexpedient because of the increase of heat flow used in melting and due to a large quantity of evolving slag.

The largest possible concentration of free metal oxides corresponds to a maximal silicon and carbon content in the iron-carbon alloy (pig iron) and its maximum portion (95%) in the proposed blended charge. These conditions provide 1) a complete oxidation of silicon, 2) formation of a hot fluid slag possessing maximal foaming and increased refining properties with regard to phosphorus and sulphur and also a high oxidizing potential. As a result, it is possible to achieve simultaneous and concurrent oxidation of phosphorus and carbon and the removal of sulphur. In other words, it is possible to combine melting and oxidation periods. The melting is characterized by a minimal duration and the output of a high-quality metal.

The composition of various exemplary oxide materials is given in Tables 1A and 1B.

TABLE 1A

| N | Materials | Content % Weight | | | | | | |
|---|---|---|---|---|---|---|---|---|
| | | Fe. common | Fe. met. | FeO | $Fe_2O_3$ | C | $SiO_2$ | $Al_2O_3$ |
| 1. | Agglomerate | 56.1 | 0.11 | 16.47 | 61.4 | 0.12 | 6.0 | 1.83 |
| 2. | Flux-free pellets (Mikhailovsky Preparation Plant) | 60.22 | — | 2.66 | 83.16 | 0.22 | 9.0 | 0.25 |
| 3. | Oxidized metal scrap | 98.3 | 90.2 | — | 11.5 | 0.25 | 1.20 | 0.22 |
| 4. | Plant scrap | 98.5 | 95.5 | — | 4.30 | 0.30 | 0.7 | — |
| 5. | Raw hot ore (Kursk Magnetic Anomaly) | 58.01 | — | 6.70 | 75.44 | — | 7.93 | 1.29 |
| 6. | Martitle ion ore (Krivbass) | 69.9 | — | 0.17 | 98.62 | 0.02 | 0.31 | — |

TABLE 1A-continued

| N | Materials | Content % Weight | | | | | | |
|---|---|---|---|---|---|---|---|---|
| | | Fe. common | Fe. met. | FeO | $Fe_2O_3$ | C | $SiO_2$ | $Al_2O_3$ |
| 7. | Scale | 74.5 | — | 63.90 | 35.40 | 0.11 | 0.15 | — |
| 8. | Dust | 46.24 | — | 3.83 | 61.80 | — | 10.03 | 0.50 |
| 9. | Sludge from wet purified in arc-furnace gas (Krasny Oktiabr Plant) | 36.23 | — | 5.84 | 43.42 | — | 6.40 | 1.89 |
| 10. | Flux-free pellets (Lebedinsky Preparation Plant) | 67.54 | — | 0.60 | 95.90 | — | 3.54 | 0.31 |

TABLE 1B

| N | Materials | Content % Weight | | | | | |
|---|---|---|---|---|---|---|---|
| | | CaO | MgO | MnO | P | S | $TiO_2$ |
| 1. | Agglomerate | 10.95 | 2.17 | 0.58 | 0.05 | 0.04 | 0.48 |
| 2. | Flux-free pellets (Mikhailovsky Preparation plant) | 4.17 | 0.33 | 0.05 | 0.02 | 0.03 | — |
| 3. | Oxidized metal scrap | — | — | 0.25 | 0.05 | 0.04 | — |
| 4. | Plant scrap | — | — | 0.50 | 0.04 | 0.03 | — |
| 5. | Raw hot ore (Kursk Magnetic Anomaly) | 1.80 | 0.24 | — | 0.02 | 0.03 | — |
| 6. | Martitle ion ore (Krivbass) | — | — | 0.03 | 0.003 | 0.007 | — |
| 7. | Scale | — | — | 0.26 | 0.014 | 0.007 | — |
| 8. | Dust | 6.45 | 6.06 | 5.46 | 0.04 | 0.16 | 4.11 |
| 9. | Sludge from wet purified in arc-furnace gas (Krasny Oktiabr Plant) | 3.08 | 15.2 | 3.43 | 0.04 | 0.38 | 15.2 |
| 10. | Flux-free pellets (Lebedinsky Preparation Plant) | 0.80 | 0.18 | 0.03 | 0.005 | 0.003 | — |

EXAMPLE

Production of electric steel containing carbon (not more than 0.035%), silicon (3%), copper (within 0.3 to 0.6%) was carried out in a 100 metric ton arc furnace. The metal charge included blended charge (13 to 35 tons), slab waste (20 to 25 tons), rolled crop ends (16 to 45 tons) and scrap (amounting to 8 to 36 tons). The blended charge material was charged in two portions; first 70% and then 30%. As slag-forming materials, we used lime (2 to 3.5 tons) agglomerate (2.5 to 4 tons) and fluorspar (0.3 to 0.5 ton). Oxygen was delivered through a free lance, total consumption per melt being within 1,200 to 1,600 cubic meters.

The blended charge was made in pig iron pouring out together with pig iron. Large melts were carried out using iron-carbon pellets produced at Mikhailovsky and Lebedinsky Preparation Plants as an oxide component. Also, agglomerate, scale, agglomerated dust and sludge and a mix of various solid oxides were used.

The molten metal contained carbon (0.1 to 1.0%), manganese (0.05 to 0.20%), phosphorus (0.007 to 0.016%), sulphur (0.018 to 0.025%), chrome and nickel (less than 0.05%), all percentages by weight. After melting, the bath was decarburized and heated, copper alloyed, oxidized, alloyed with silicon and tapped. Then ladle treatment and continuous teeming was carried out. See Table 2 (reporting melting carried out on the suggested and familiar blends) and Table 3 (reporting ready production grading).

TABLE 2

| Blend Composition 1 | Component content in mass % iron-carbon alloy (ICA) 2 | oxide material (OM) 3 | Concentration of free iron oxides in (OM) in mass % 4 | Slag tenacity in mm 5 | Time of melting in hours and minutes 6 | Power wasted on melting in kWt per hour 7 | Output of hot steel in % of total charge amount 8 |
|---|---|---|---|---|---|---|---|
| 1 | unknown | — | 85.27 | — | 3-35 | 54200 | 91.80 |
| 2 | 45 | 55 | 0.20 | 100 | 3-15 | 52300 | 90.1 |
| 3 | 50 | 50 | 0.25 | 140 | 3-05 | 50900 | 92.1 |
| 4 | 59 | 41 | 18.70 | 160 | 2-50 | 48700 | 93.0 |
| 5 | 70 | 30 | 46.90 | 180 | 2-35 | 46800 | 93.8 |
| 6 | 75 | 25 | 81.00 | 165 | 2-40 | 46200 | 94.1 |
| 7 | 80 | 20 | 86.00 | 140 | 2-55 | 47800 | 94.3 |
| 8 | 90 | 10 | 99.50 | 100 | 3-00 | 48700 | 93.2 |
| 9 | 95 | 5 | 98.00 | 65 | 3-10 | 51100 | 92.8 |
| 10 | 97 | 3 | 96.00 | 40 | 3-30 | 53200 | 91.9 |

machines where various oxide materials were poured

TABLE 3

| Blend composition | Sheet width in mm | No. of heats | No. of ready production lots | Grading in % 3409 | 3408 | 3407 | 3406 | 3405 | 3404 | other | scrap |
|---|---|---|---|---|---|---|---|---|---|---|---|
| 1 | 0.35 | 64 | 698 | 0.3 | 14.2 | 35.7 | 24.5 | 12.6 | 4.4 | 4.7 | 1.6 |
| 2 | 0.35 | 3 | 37 | 10.8 | 40.6 | 29.7 | 5.4 | 5.4 | — | 8.1 | — |

Referring to Tables 2 and 3, blend composition 1 is a prior art prototype. Blend compositions 2 to 10 are according to this invention. Table 2 shows that a blended charge according to this invention can cut down the period of melting from 20 to 60 minutes. It reduced power flow wasted on melting by 5 to 15% and also increased the output of hot steel preferred compositions.

Referring to Table 3, the best results correspond to the preferred blended charge. The products made of steel melted from the preferred blended charge are characterized by excellent electromagnetic properties in comparison with the prior art prototype. The amount of quality production thereby exceeds by 80% as compared with 50% when employing the prototype. Apart from electrotechnical steel, the blended charge was tested in the production of plain carbon steels. The tests proved the possibility to use the new blended charge in the production of various steel grades.

Having thus described our invention with the detail and particularity required by the Patent Laws, what is desired to be protected by Letters Patent is set forth in the following claims.

We claim:

1. A blended charge in steelmaking batch comprising:

a) 50 to 95% by weight of an iron-carbon alloy; and b) 5 to 50% by weight oxide material, said oxide material including free metallic oxides in excess of 0.25% by weight whose metal has an affinity for oxygen less than or equal to the affinity of carbon for oxygen in molten steel.

2. A blended charge according to claim 1, wherein a metal of the free metallic oxides is selected from the group consisting of manganese, chrome, nickel, molybdenum, tungsten and cobalt.

3. The blended charge according to claims 1 or 2, wherein the blended charge comprises 70 to 80% by weight iron-carbon alloy and 30 to 20% by weight of oxide material including free metallic oxides.

4. The blended charge according to claims 1 or 2, wherein the remaining portion of the oxide material other than the free metallic oxides substantially comprises iron oxides.

5. The blended charge according to claims 1 or 2, wherein the oxide material comprises iron ore, scale, flue dust, sludge from metallurgical processes and mixtures thereof.

6. The blended charge according to claims 1 or 2, wherein the iron-carbon alloy comprises 0.2 to 4.5% by weight carbon.

7. The blended charge according to claim 1, wherein in the case of decarburization, the oxide form of the blended charge material allows early decarburization as compared to the slag-metal reaction.

8. The blended charge according to claim 1, wherein the chemical potential of oxygen reaches a maximum which is one or two orders of magnitude greater than gaseous oxygen.

9. The blended charge according to claim 1, wherein the parallel and simultaneous oxidation of the other elements occurs with the blended material where as it does not in normal steelmaking until after substantially all carbon is reacted.

10. The blended charge according to claim 1, wherein the initial reaction of carbon oxidation occurs at a lower temperature compared to normal melts.

11. The blended charge according to claim 1, wherein the carbon oxidation rate reaches the intensity of that in a basic oxygen furnace and is continuous allowing the bath to be highly mixed and homogeneous.

12. The blended charge according to claim 1, wherein upon melting the molten metal therefrom consists essentially of:

0.1 to 1.0 weight percent carbon,
0.05 to 0.20 weight percent manganese,
0.007 to 0.016 weight percent phosphorous,
0.018 to 0.025 weight percent sulphur,
less than 0.05 weight percent chrome,
less than 0.05 weight percent nickel.

* * * * *